US012378770B2

(12) United States Patent
Wohletz

(10) Patent No.: US 12,378,770 B2
(45) Date of Patent: Aug. 5, 2025

(54) GUTTER GUARD SYSTEM

(71) Applicant: Eligius Group, LLC, Wichita, KS (US)

(72) Inventor: David E Wohletz, St. Marys, KS (US)

(73) Assignee: Eligius Group, LLC, Wichita, KS (US)

( * ) Notice: Subject to any disclaimer, the term of this patent is extended or adjusted under 35 U.S.C. 154(b) by 201 days.

(21) Appl. No.: 18/299,333

(22) Filed: Apr. 12, 2023

(65) Prior Publication Data

US 2023/0323671 A1 Oct. 12, 2023

Related U.S. Application Data

(60) Provisional application No. 63/362,843, filed on Apr. 12, 2022.

(51) Int. Cl.
*E04D 13/076* (2006.01)

(52) U.S. Cl.
CPC ..... *E04D 13/076* (2013.01)

(58) Field of Classification Search
CPC ..... E04D 13/064; E04D 13/076
See application file for complete search history.

(56) References Cited

U.S. PATENT DOCUMENTS 7,908,797 B2 * 3/2011 Graves ..... E04D 13/076 52/12
8,276,321 B2 * 10/2012 Bell ..... E04D 13/0725 52/12
8,322,082 B2 * 12/2012 Neumann ..... E04D 13/076 52/12
D683,827 S * 6/2013 Ealer, Sr. ..... D23/267
8,578,658 B2 * 11/2013 Snell ..... E04D 13/076 52/12
8,776,444 B2 * 7/2014 Beck ..... E04D 13/076 52/12
D781,403 S * 3/2017 Jordan ..... D23/267
10,113,315 B2 * 10/2018 Cullen ..... E04D 13/076
10,676,932 B2 * 6/2020 Miller, Jr. ..... E04D 13/076
11,060,293 B2 * 7/2021 Graves ..... E04D 13/076
11,174,642 B2 * 11/2021 Miller ..... E04D 13/064
2006/0201068 A1 * 9/2006 Shane ..... E04D 13/064 52/11

FOREIGN PATENT DOCUMENTS

DE 3931020 A1 * 5/1990

* cited by examiner

*Primary Examiner* — Adriana Figueroa
(74) *Attorney, Agent, or Firm* — AVEK IP, LLC

(57) ABSTRACT

A device may include a sheet having a raised edge at an end and an angled edge at an opposing end, the angled edge having a first ledge and a second ledge. The device may include a first region adjacent the angled edge and a second region adjacent the raised edge. A dam may be located between the first region and the second region. A first set of indentations may be formed in the first region, the first set of indentations having an area configured to allow passage of liquid, and another area configured to prevent passage of debris. A second set of indentations may be formed in the second region, the second set of indentations having an area configured to allow passage of liquid, and another area configured to prevent passage of debris. A plurality of fasteners may be used to secure the device to a gutter.

20 Claims, 10 Drawing Sheets

GUTTER GUARD SYSTEM

This application claims priority to U.S. Provisional Application No. 63/362,843, filed Apr. 12, 2022, the disclosure of which is incorporated herein by reference in its entirety.

FIELD OF THE DISCLOSURE

This disclosure relates to gutter systems, and more specifically, to guards for gutter systems that preclude the entry of debris while allowing passage for fluid.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the techniques described herein relate to a system for preventing debris from entering a gutter, including a sheet having a raised edge at an end and an angled edge at an opposing end, the angled edge having a first ledge and a second ledge coupled to the first ledge. The system includes a first region adjacent the angled edge, a second region adjacent the raised edge, and a dam located between the first region and the second region, the dam being a protrusion that extends above both the first region and the second region. The system includes a first set of indentations formed in the first region, the first set of indentations having an area configured to allow passage of liquid through a thickness of the sheet, and another area configured to prevent passage of debris through the thickness of the sheet. The system includes a second set of indentations formed in the second region, the second set of indentations having an area configured to allow passage of liquid through the thickness of the sheet, and another area configured to prevent passage of debris through the thickness of the sheet. The system includes a plurality of fasteners for securing each of the raised edge and the angled edge to the gutter.

In some aspects, the techniques described herein relate to a system, wherein the first region extends from the angled edge to the dam, and the second region extends from the raised edge to the dam.

In some aspects, the techniques described herein relate to a system, wherein the dam is a sloped protrusion that joins the first region with the second region.

In some aspects, the techniques described herein relate to a system, wherein the first set of indentations includes a first plurality of strips which are attached to the surface of the first region, and the second set of indentations includes a second plurality of strips which are attached to the surface of the second region.

In some aspects, the techniques described herein relate to a system, wherein no material is removed from the sheet when forming the first set of indentations and the second set of indentations.

In some aspects, the techniques described herein relate to a system, further including a plurality of apertures in each of the raised edge and the angled edge, and wherein the plurality of fasteners are bolts.

In some aspects, the techniques described herein relate to a system, wherein each of the first set of indentations and the second set of indentations include two or more rows, wherein each of the two or more rows include a plurality of discrete openings in the sheet.

In some aspects, the techniques described herein relate to a system, wherein each row of the two or more rows is staggered from another row of the two or more rows.

In some aspects, the techniques described herein relate to a system, wherein the sheet is made of metal.

In some aspects, the techniques described herein relate to a system, wherein each of the first region and the second region are angled towards the dam.

In some aspects, the techniques described herein relate to a system, wherein one of the first ledge and the second ledge of the raised edge extends from the second region at an eighty-degree angle.

In some aspects, the techniques described herein relate to a guard system for use with a gutter, including a sheet having a raised edge at an end and an angled edge at an opposing end, the angled edge having a first ledge and a second ledge coupled to the first ledge. The system includes a first region adjacent the angled edge, a second region adjacent the raised edge, and a dam located between the first region and the second region. The system includes a first set of indentations formed in the first region, and a second set of indentations formed in the second region, wherein the first set of indentations and the second set of indentations are configured to allow liquid to pass through a thickness of the sheet while precluding passage of debris.

In some aspects, the techniques described herein relate to a system, wherein the guard system is removably attachable to the gutter.

In some aspects, the techniques described herein relate to a system, wherein the guard system is made integral with the gutter.

In some aspects, the techniques described herein relate to a system, further including a third region having a third set of indentations, and a second dam.

In some aspects, the techniques described herein relate to a system, wherein the third region is arranged between the first region and the second region, and the second dam is arranged between the third region and one of the first region and the second region.

In some aspects, the techniques described herein relate to a system, wherein the raised edge extends at a ninety-degree angle from the sheet.

In some aspects, the techniques described herein relate to a system for preventing debris from entering a gutter, including a sheet having a raised edge at an end and an angled edge at an opposing end, the angled edge having a first ledge and a second ledge coupled to the first ledge. The system includes a first region located between the raised edge and the angled edge and a dam, the dam extending above the first region. The system includes a first set of indentations formed in the first region, the first set of indentations including a plurality of discrete openings in the sheet, wherein the first set of indentions allow only liquid to pass through a thickness of the sheet.

In some aspects, the techniques described herein relate to a system, further including a protective coating over a top surface of the sheet.

In some aspects, the techniques described herein relate to a system, wherein the sheet and the gutter are both constructed of a first material.

BRIEF DESCRIPTION OF THE SEVERAL VIEWS OF THE DRAWINGS

Illustrative embodiments of the present disclosure are described in detail below with reference to the attached drawing figures and wherein.

DETAILED DESCRIPTION

Gutters are troughs or sheaths designed for the collecting and conveying of fluid (e.g., rainwater). Gutters are typically arranged around the perimeter of a building roof such that the gutter can gather and relocate rainwater to a desired location (e.g., down a gutter spout and away from the foundation). Without gutters, rainwater may fall off or pool in undesirable areas and cause damage. An issue with conventional gutters is that they unintendedly collect various debris (e.g., rocks, stick and twigs, leaves, dirt, etc.) during normal operation. This debris has a detrimental effect on the gutter's efficacy as the debris builds up and clogs the openings in the gutter. Rainwater that cannot be conveyed as intended, due to this buildup of debris, may backup and overflow in undesirable areas, often causing water damage to property. Furthermore, the gutters themselves may be at risk of damage when they become overburdened with debris. When the gutters get too heavy with clogged debris, the gutters may fail and break off from the building they are attached to, damaging the gutter system and/or whatever the broken gutters fall on.

It may be advantageous to have a device that may protect a gutter system from debris, allow the gutter system to perform sufficiently even in the presence of debris, and/or which aids in the unloading of the debris from the gutter system. Embodiments of a gutter guard system disclosed herein may provide for such a device.

FIGS. 1A-8 detail an embodiment 100 of a gutter guard system for use with a gutter or series of gutters. The gutter guard system 100 may have a plurality of features which provide protection to a gutter system, such that debris may be precluded from stopping proper rainwater flow through the gutter system. The gutter guard system 100 may, in embodiments, alternatively or additionally facilitate automatic debris removal. While the figures display straight, partial portions of a gutter 50 and the gutter guard system 100, the artisan would understand that embodiments of the gutter guard system 100 may instead have any suitable shape or size to fit any gutter system, now known or subsequently developed, for conveying rainwater. For example, embodiments of the gutter guard system may include sections that are bent, curved, and/or angled to fit elbows or other non-straight portions of a gutter 50.

Figure 1A:
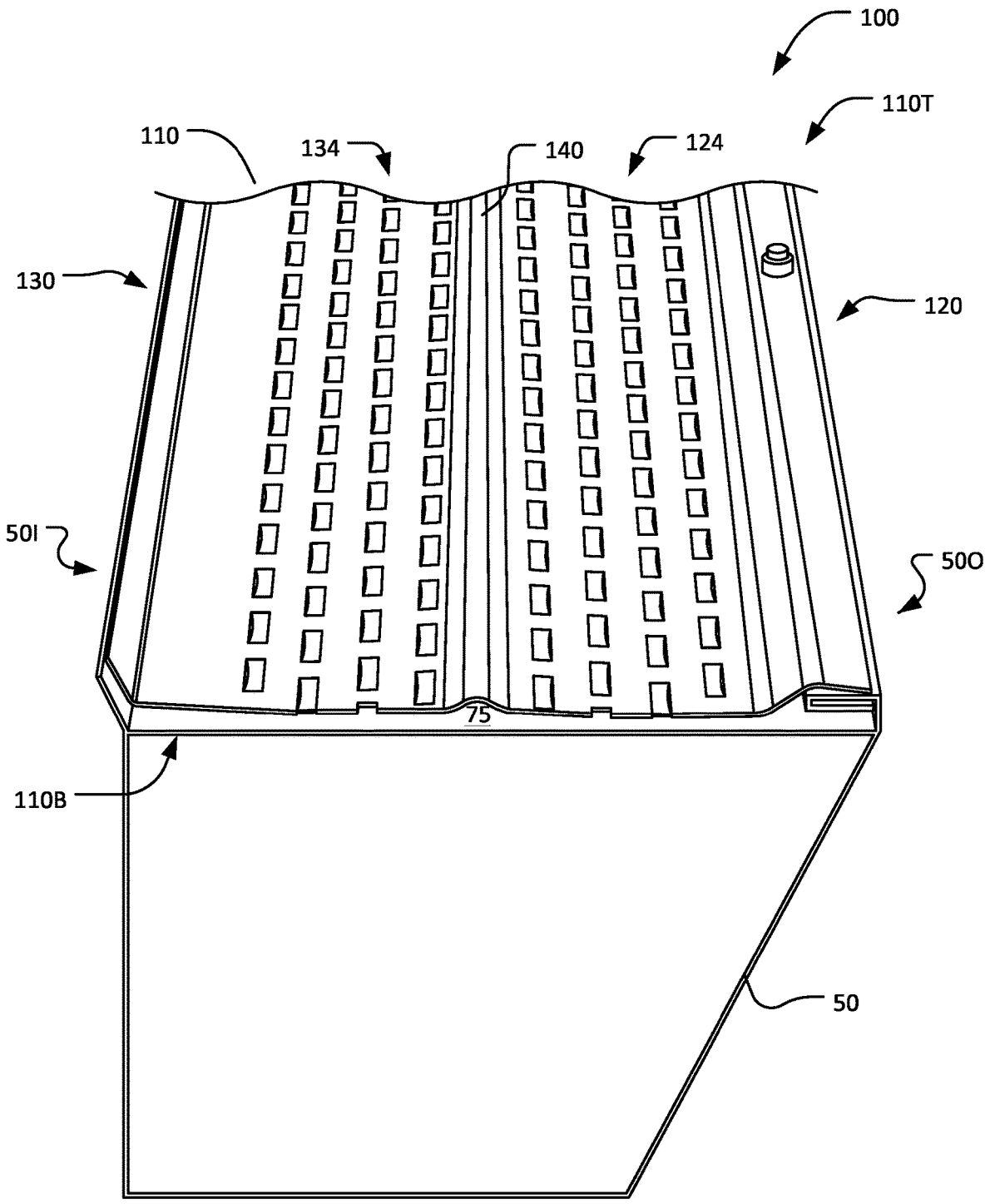
FIG. 1A is a side perspective view of a gutter with a gutter guard system, according to an embodiment of the disclosure.
Figure 1B:
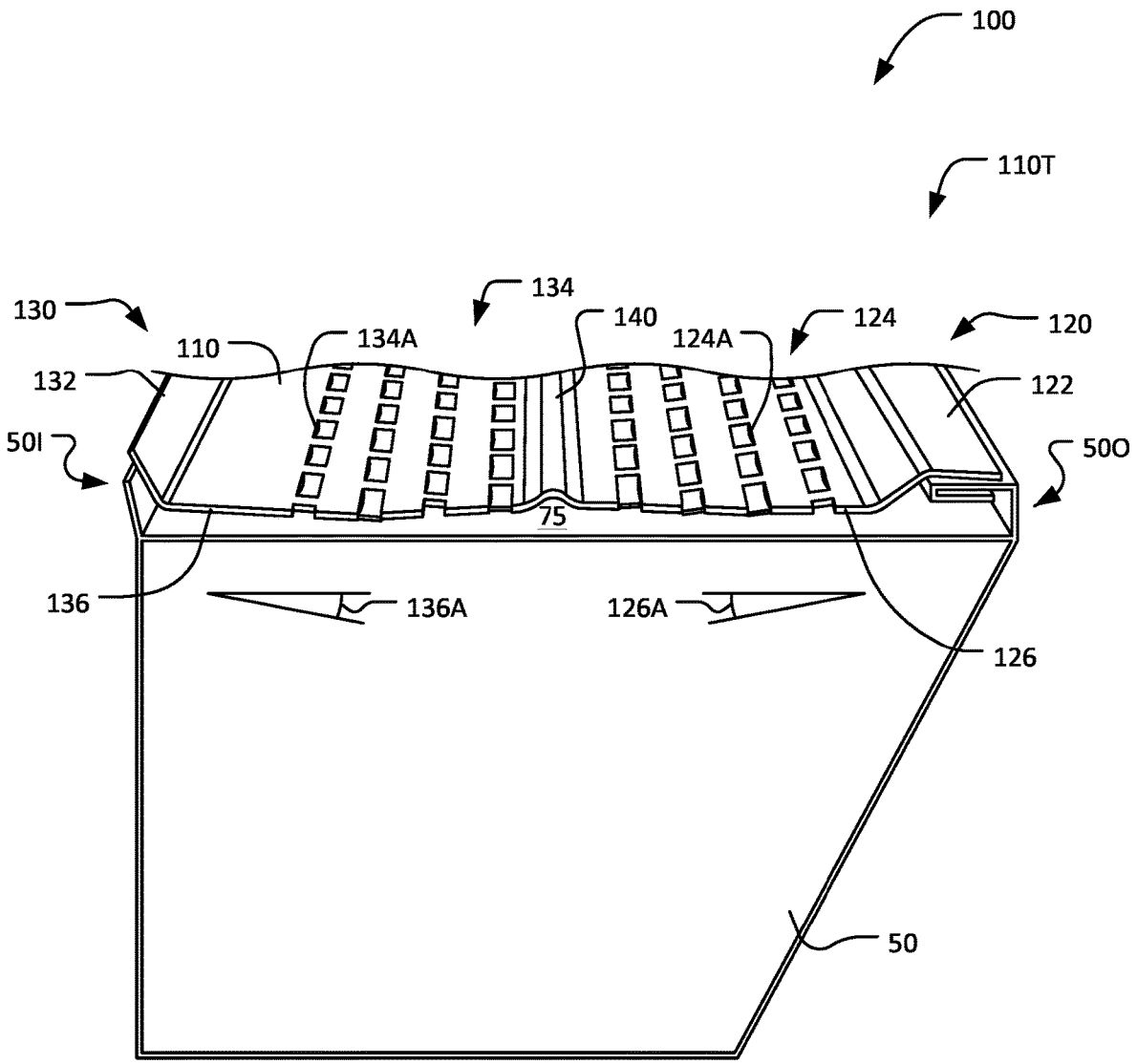
FIG. 1B is a detailed side perspective view of the gutter with the gutter guard system of FIG. 1A.
Figure 2:
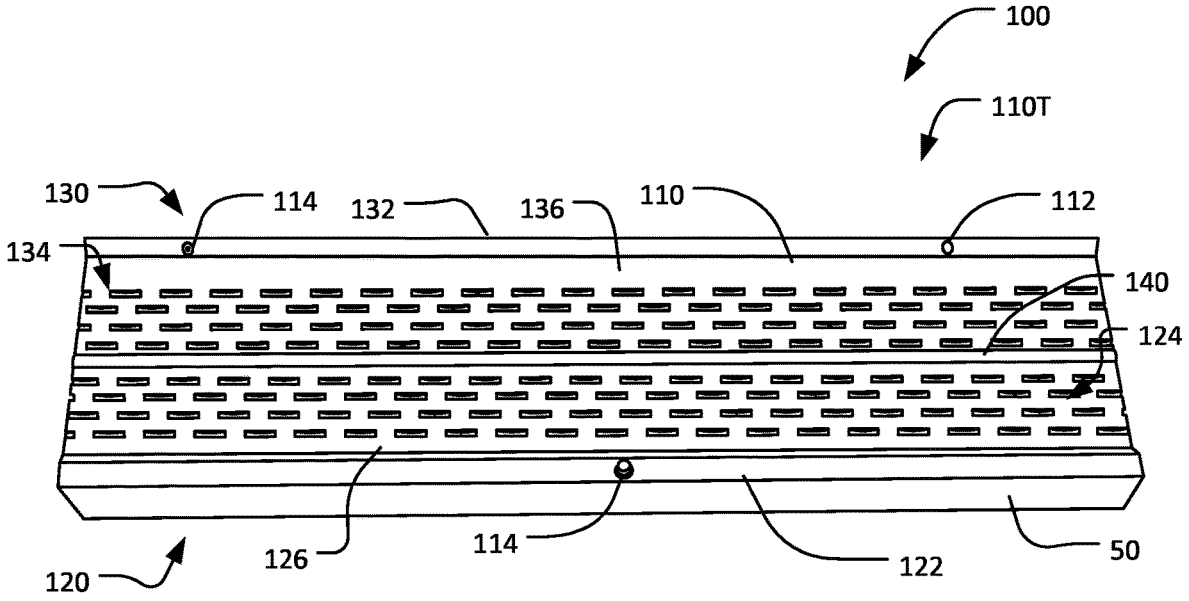
FIG. 2 is a top perspective view of the gutter with the gutter guard system of FIG. 1A.

FIGS. 1A, 1B and 2 show the gutter guard system 100 attached to an example gutter 50 having a gutter interior 75. The interior 75 of the gutter 50 may be where liquid (e.g., rainwater, melted snow, etc.) is intended to be gathered and rerouted, and where it may be desirable to prevent debris (rocks, sticks, leaves, tree nuts, etc.) from entering. The gutter guard system 100 comprises a piece of shaped sheet metal 110 having a front or outward facing portion 120 and a rear or inward facing portion 130. The sheet metal 110 may be a relatively thin piece of material that is configured to fit over the top of the gutter 50, thus obscuring the opening and the interior 75 of the gutter 50. Due to front portion perforations or indentations 124, rear portion perforations or indentations 134, and a dam 140, liquid such as rainwater may still reach the interior 75 relatively unimpeded and the gutter 50 may function as normal. At the same time, debris may be prevented or precluded from entering the gutter 50 by these same features. The terms "precluded," "prevented," and "not allowed" as used herein with respect to debris entering the gutter 50 are intended to indicate that the system 100 may allow less debris to enter the gutter 50 relative to a gutter 50 having no such system 100. As a result, the risk of debris buildup in the gutter 50 may be mitigated and liquid may still be collected and relocated by the gutter 50, as intended.

Figure 3:
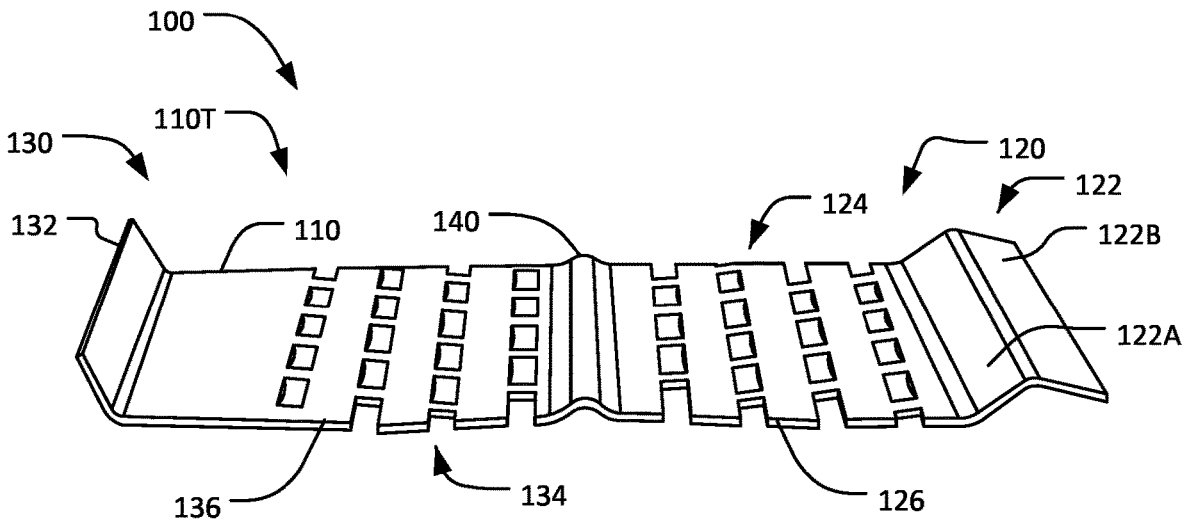
FIG. 3 is a side perspective view of the gutter guard system of FIG. 1A.
Figure 4:
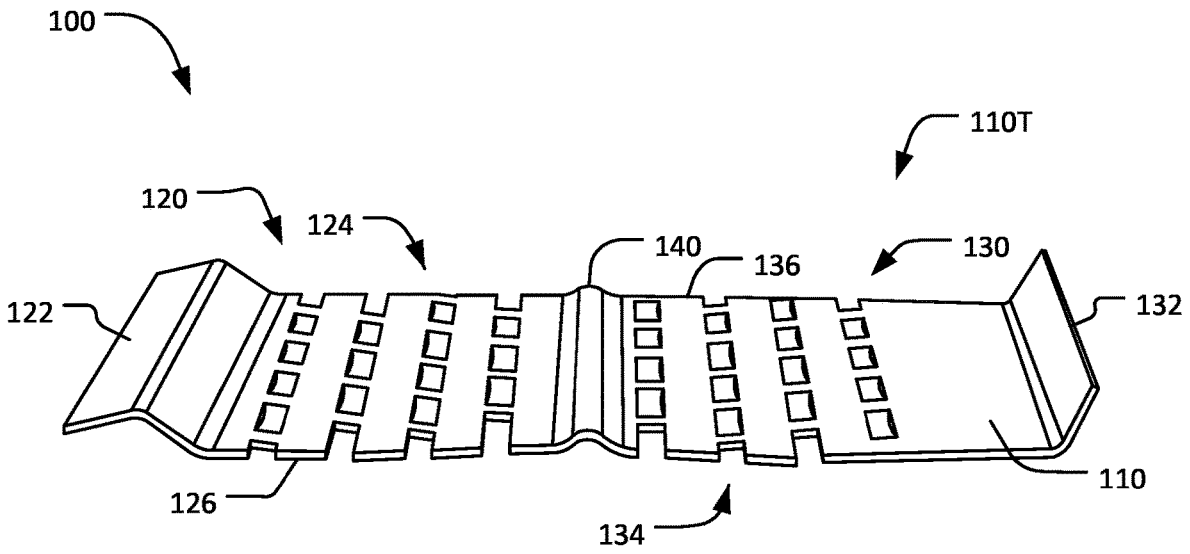
FIG. 4 is another side perspective view of the gutter guard system of FIG. 1A.
Figure 5:
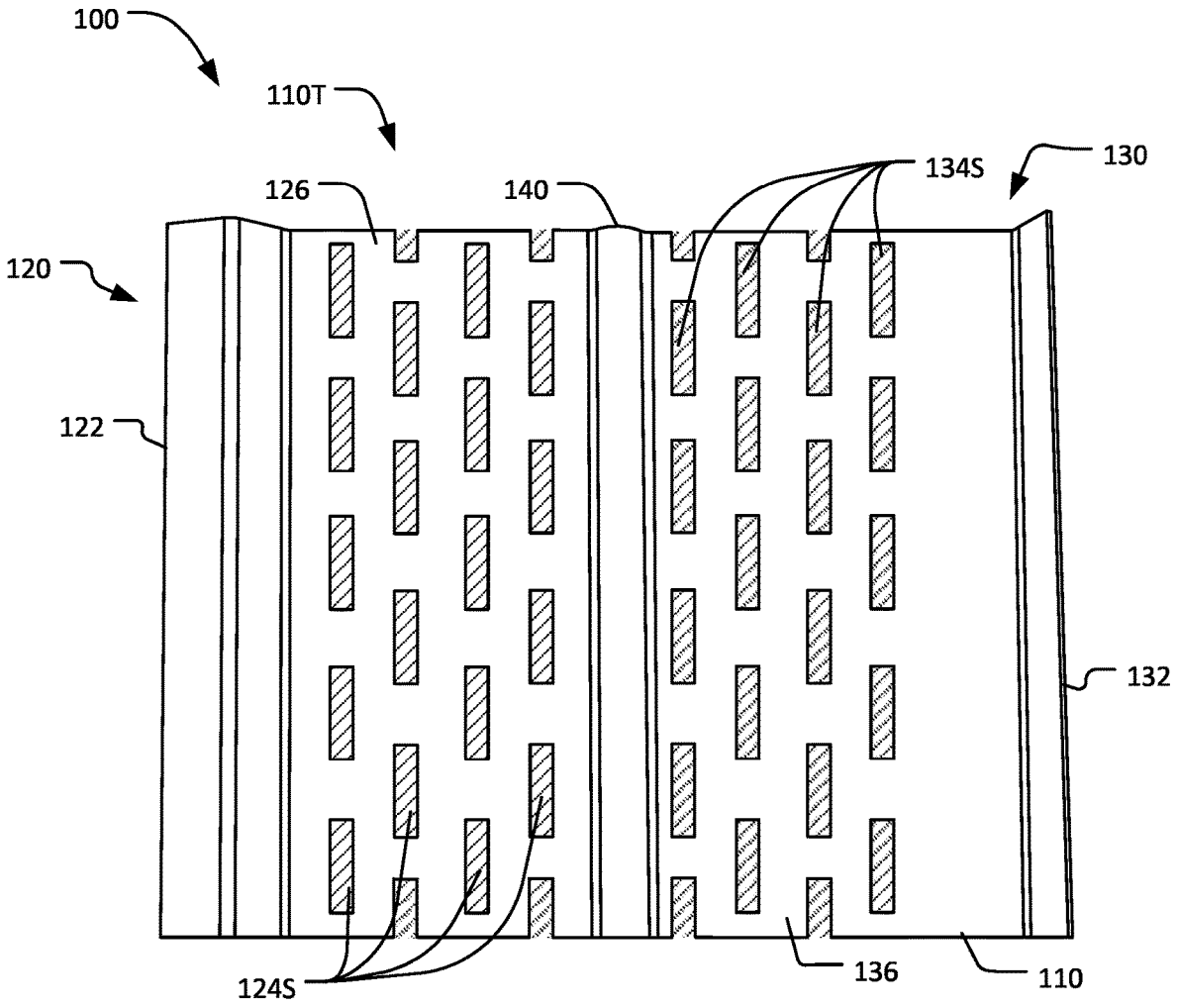
FIG. 5 is a top view of the gutter guard system of FIG. 1A.
Figure 6:
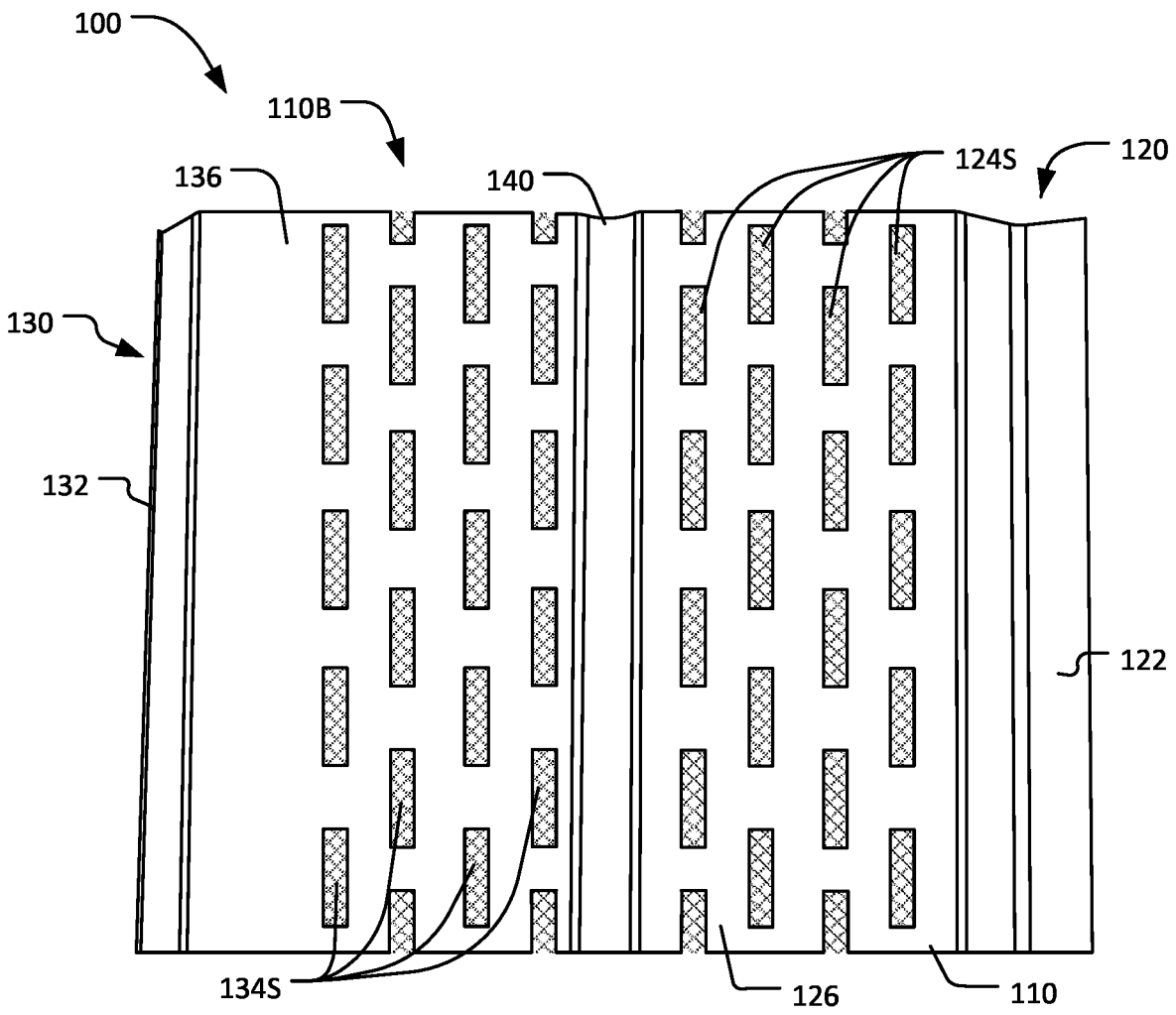
FIG. 6 is a bottom view of the gutter guard system of FIG. 1A.
Figure 7:
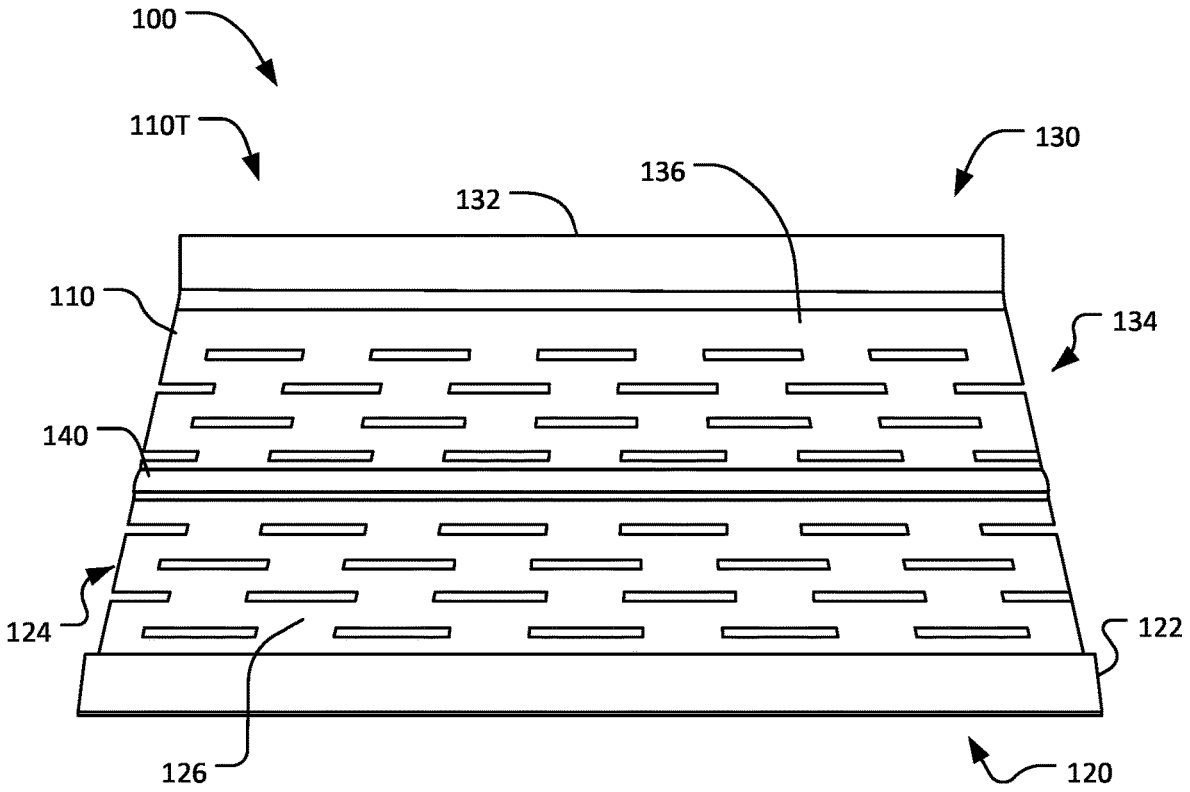
FIG. 7 is a front perspective view of the gutter guard system of FIG. 1A.
Figure 8:
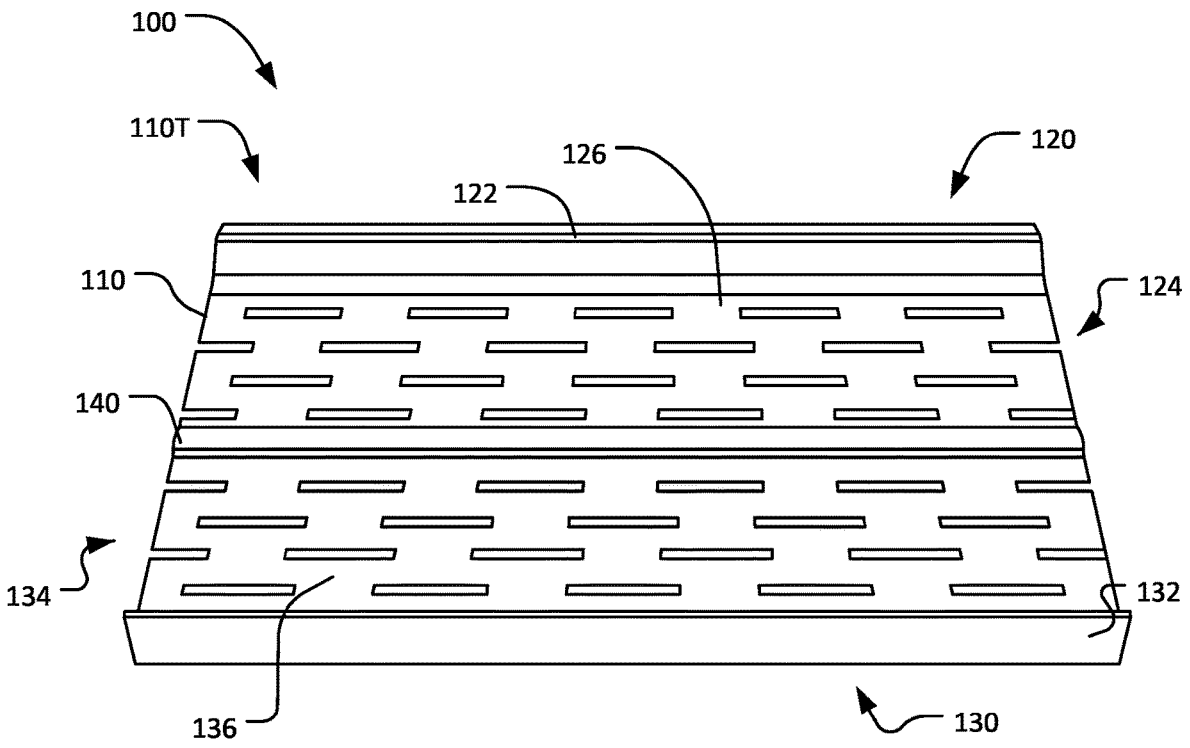
FIG. 8 is a rear perspective view of the gutter guard system of FIG. 1A.

As shown in further detail in FIGS. 2-4, the sheet metal 110 of the gutter guard system 100 may comprise the front portion 120, the rear portion 130. The dam 140 may be located between and join together the portions 120 and 130. The front portion 120 may mate with or abut an outer perimeter or edge 500 (FIGS. 1A and 1B) of the gutter 50, which may generally be the portion of the gutter 50 facing away from the building to which the gutter 50 is attached. The rear portion 130 may mate or abut an inner perimeter or edge 501 of the gutter 50, which may generally be the portion of the gutter 50 that is facing or is in contact with the building to which the gutter 50 is attached. The front portion 120 may comprise an angled edge 122 (e.g., an edge having at least one surface angled at about forty-five-degrees from the first region 126) and a first region 126 adjacent the angled edge 122 having the first series of perforations 124. Similarly, the rear portion 130 may comprise a raised edge 132 (e.g., an edge having at least one surface extending from the second region 136 at about an eighty-degree-angle) and a second region 136 adjacent the raised edge 132 having the second series of perforations 134. The dam 140 may be a protrusion or extension which may rise (e.g., away from the gutter 50) above the regions 126 and 136 while also bridging the two regions 126 and 136 together. These features are depicted in further detail in FIGS. 5-8.

The angled edge 122 and the raised edge 132 may mate with or abut the outer end 500 and the inner end 501 of the gutter 50, respectively. The angled edge 122 may comprise a surface 122A and a surface 122B (FIG. 3) joined together in a "V-like" formation extending from the region 126. In embodiments, the surface 122A may extend from the first region 126 at about a forty-five-degree angle, while the surface 122B may extend roughly parallel (e.g., within five degrees) to the region 126. With such a sloped configuration, the angled edge 122 may provide for a surface which debris may easily slide off of, relative to a much sharper angled edge. One or more of the surfaces 122A and 122B may extend over the top of or even beyond the outer edge 500 of the gutter. In embodiments, apertures 112 may be formed in the surface 122A and/or 122B for reception of the fasteners 114. The angled edge 122 may allow debris to "blow off" (e.g., via wind and/or gravity) away from the gutter guard 100 while retaining rainwater within the gutter 50, and the raised edge 132 may preclude rainwater from running back behind the gutter 50 (an issue that occurs where the gutter 50 is not flush with the building due to, for example, misalignment or warping) while providing reinforcement to the gutter guard system 100. As best seen in FIG. 2, the edges 122 and 132 may further comprise attachment features, such as apertures 112 for the reception of fasteners 114 (e.g., screws, nails, bolts, rivets, et cetera). Other attachment features, such as clamp, welding, or adhesive methods, may be used alternatively or additionally to the fasteners 114, and such embodiments are contemplated herein and are within the scope of the disclosure. Through these attachment features, the gutter guard system 100 may be coupled (e.g., permanently or removably) to the gutter 50 and/or the building itself, allowing a conventional gutter 50 to be retrofitted or upgraded with the gutter guard system 100. In some embodiments, the gutter guard system 100 may be made integral with the gutter 50, such as by being formed as part of the gutter 50 having the system 100 during manufacture.

The two regions 126 and 136, and the two sets of perforations 124 and 134 therein, may be relatively similar, and thus will be described together. The first region 126 may span the distance between the angled edge 122 and the dam 140, and the second region 136 may span the distance between the raised edge 132 and the dam 140. These regions 126 and 136 may be relatively flat portions of the sheet metal 110 that contain the perforations 124 and 134 which allow liquid to flow through the gutter guard system 100 and into the gutter 50. The perforations 124 and 134 may each be a plurality of openings in the sheet metal 110 where the sheet metal is not completely removed. In other words, the perforations 124 and 134 may each be a plurality of portions of the sheet metal 110 that are pressed inward to create apertures 124A and 134A (FIG. 1B), respectively, between the surface 110T and the strips 124S and 134S (FIG. 5), respectively, which allow liquid to pass through a thickness of the sheet metal 110.

The regions 126 and 136 may be further configured to facilitate this flow of liquid. To put it another way, the regions 126 and 136 may be relatively free of raised surfaces (e.g., surfaces rising above the sheet metal 110) or other obstructions which may preclude the flow of liquid to the gutter 50. In some embodiments, the regions 126 and 136 may be arranged such that the regions 126 and 136 increase the flow of water to the gutter 50, such as by being angled at angle 126A and 136A (FIG. 1B), respectively, towards the center of the gutter guard system 100 (e.g., angled towards the dam 140). The angles 126A and 136A may be acute angles from a plane that extends along a top of the gutter 50. While the regions 126 and 136 depicted in the figures are of roughly the same size, embodiments of the gutter guard system have regions 126 and 136 that are of disparate sizes.

The perforations 124 and 134 may each comprise a plurality of apertures 124A and 134A, respectively, (e.g., holes, slits, vents, clefts, indentations, etc.) that allow fluid communication between a top portion or surface 100T of the gutter guard system 100 and a bottom portion or surface 100B (FIG. 6) of the gutter guard system 100. The perforations 124 and 134 may be configured to allow the passage of fluid therethrough while also precluding the passage of debris. To this end, the perforations 124 and 134 may be configured such that typical debris would have a harder, or even impossible, time passing through the perforations 124 and 134. The perforations 124 and 134 may thus have any suitable size, spacing arrangement, spacing density, and/or shape to further this purpose. One embodiment of the perforations 124 and 134, shown here in the figures, involves indenting the sheet metal 110 within the regions 126 and 136. This creates perforations 124 and 134 that have strips 124S and 134S (FIGS. 5 and 6) of sheet metal 110 along a bottom end thereof and openings 124A and 134A to the bottom 100B of the system 100 along the sides of these strips. The diagonal shading in FIG. 5 indicate that the strips 124S and 134S are extending into the page, and the cross-hatched shading in FIG. 6 indicate that the strips 124S and 134S are extending out of the page. Such perforation 124 and 134 configurations may prevent larger objects from unduly entering the gutter 50 via the strips of sheet metal 110, while fluid is still able to pass over the sides of the strips. By indenting the sheet metal 110, the perforations 124 and 134 may be formed therein without removing material from the sheet metal 110. The artisan would understand however that gutter guard system embodiments are not limited to such a configuration, and that other perforation 124 and 134 configurations are contemplated herein and within the scope of the disclosure.

The perforations 124 and 134 may reside in the regions 126 and 136, respectively, though in embodiments, the perforations 124 and 134 need not fill the entirety of these regions 126 and 136. Embodiments of the perforations 124 and 134 may be modified to have any suitable pattern or arrangement as desired. For example, the number, size, spacing, and/or density of perforations 124 and 134 may be adjusted to better suit certain gutter guard applications. While the perforations 124 and the perforations 134 may have a similar arrangement in their respective regions, this need not be the case. Rather, in some embodiments, the arrangement or configuration of the perforations 124 may differ from the arrangement or configuration of the perforations 134 (e.g., one of the regions 126 and 136 has more and/or different sized perforations 124 and 134 than the other, et cetera). In still some embodiments, one of the regions 126 and 136 may be devoid or essentially devoid of perforations 124 and 134.

The dam 140 located between the front portion 120 and the rear portion 130 may be a protrusion or extension which rises above the regions 126 and 136. Besides adding to the structural integrity of the gutter guard system 100, the dam 140 may assist in controlling the flow of fluid to the gutter interior 75. For instance, in cases where there is a large amount of rainwater entering the gutter guard system 100, the dam 140 may slow down and contain the rainwater. This may make the flow of rainwater into the gutter 50 more manageable and may improve the efficacy of the gutter 50 itself. In embodiments, the dam 140 alternately or additionally provides a lifted surface which may elevate debris that comes to rest on the top 100T of the gutter guard system 100 above the regions 126 and 136. Elevating the debris may promote fluid circulation around any built-up debris. Liquids may still be able to flow around the lifted debris and into the gutter 50 at a decent rate, relative to a system where the debris is not lifted by the dam 140. Further, lifting the debris may allow air currents to dry out and blow away the debris. Debris that does not have such air circulation may remain damp for longer periods of time, which unduly promotes the growth of mold and mildew. Furthermore, damp debris may be heavier and stick more to the gutter guard 100, which often contributes to unwanted debris buildup in the gutter 50. The dam 140 may prevent some or all of this build up by effectively "self-cleaning" the gutter guard system 100. That is to say, characteristics of the dam 140 may promote the automatic removal of debris from the gutter guard system 100 with little to no human intervention, relative to conventional gutter systems.

The sheet metal 110 and the fasteners 114 may be made from any suitable material or combination of materials (i.e., alloys) now known or subsequently developed, such as steel, stainless steel, zinc, aluminum, copper, brass, et cetera. In embodiments, the system 100 may be constructed wholly or partially out a polymer material, such as PVC. In some embodiments, one or more components of the gutter guard system 100 may be made of a material which is compatible with the preexisting gutter 50. That is to say, the gutter guard system 100 materials may be selected to maintain fidelity with the gutters 50 and/or to prevent issues such as disparate expansion/contraction rates, electrolysis separation, warping, "oil canning," et cetera. The gutter guard system 100 (e.g., an upper surface 100T thereof) may be painted to aesthetically match the gutters 50 the system 100 is to be attached to or formed as part of. In some embodiments, the gutter guard system 100 may have a protective coat or paint applied thereto to impart additional corrosion and/or damage resistant properties.

Figure 9:
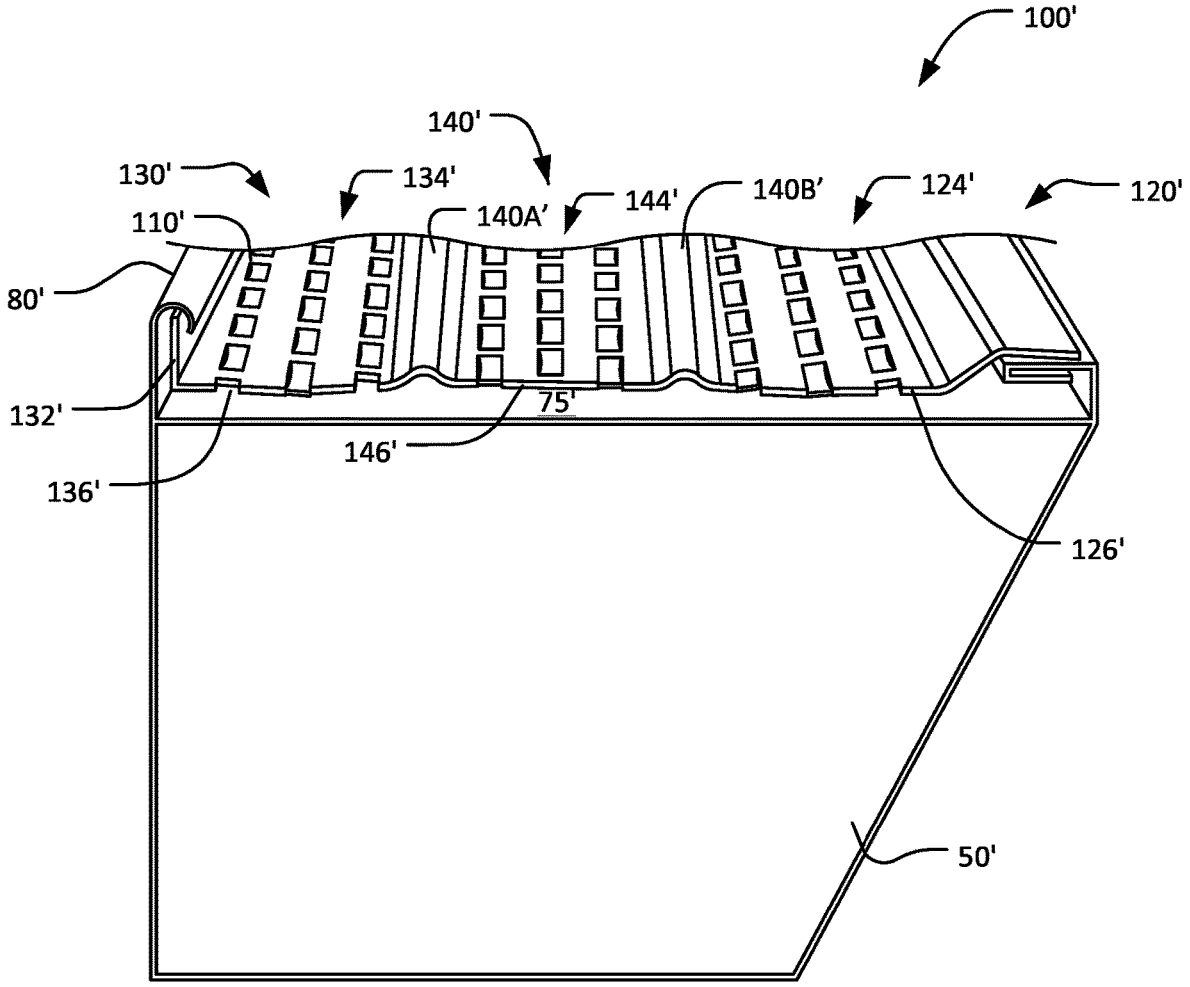
FIG. 9 is a side perspective view of a gutter with a gutter guard system, according to another embodiment of the disclosure.

FIG. 9 depicts an embodiment 100' of the gutter guard system showcasing an alternate arrangement. The system 100' may be substantially the same as the system 100, except where explicitly noted or would be inherently implied. One significant difference between the system 100' and the system 100 is that the system 100' may have an additional middle portion 140'. This middle portion 140' between portions 120' and 130', which may be bounded by water dams 140A' and 140B', and may contain a region 146' having a set of perforations 144'. Furthermore, the system 100' may have a raised edge 132' that extends from the region 136' of the sheet metal 110' at a ninety-degree angle. Such a raised edge 132' may make the gutter guard system 100' compatible with various gutter types, such as round gutters. A rounded edge 80' of a rounded gutter 50' may wrap around the raised edge 132' and thereby help retain the gutter guard system 100'. The additional middle portion 140' may further facilitate fluid flow to the gutter interior 75' and/or preclude debris buildup.

Several advantages may stem from the above-described gutter guard system embodiments. The gutter guard system embodiments may facilitate passage of fluid into and through the gutters 50, while mitigating the interference of unwanted debris. For example, rainwater may be effectively guided into the gutters 50 via the angled edge 122, the dam 140, and the sets of perforations 124 and 134. Meanwhile, the same dam 140 and sets of perforations 124 and 134 may be configured to preclude debris from interfering with this fluid flow. Debris may be too large or of the wrong shape to enter the perforations 124 and 134, and the dam 140 may elevate debris that has come to rest on the top 100T of the gutter guard system 100, away from the perforations 124 134. The gutter guard system 100 may require relatively less maintenance by having self-cleaning properties, in that the dam 140 may promote air circulation around debris that has collected on the gutter guard system 100. This may allow the debris to dry out and blow away on its own accord, without little to no human intervention.

The above description clearly establishes the advantages provided by the present disclosure which need not be explained in greater detail to those skilled in the art, who will also recognize that various design modifications and differing components can be introduced within the scope of the present disclosure as set forth herein. Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and sub-combinations are of utility and may be employed without reference to other features and sub-combinations and are contemplated within the scope of the disclosure.

The invention claimed is:

1. A system for preventing debris from entering a gutter, comprising: a sheet having a raised edge at an end and an angled edge at an opposing end, the angled edge having a first surface and a second surface coupled to the first surface; a first region adjacent the angled edge, the first region extending down from the angled edge at a first angle; a second region adjacent the raised edge, the second region extending down from the raised edge at a second angle; a dam located between the first region and the second region, the dam being a protrusion that extends above both a majority of the first region and a majority of the second region;

a first set of indentations formed in the first region, the first set of indentations having an area configured to allow passage of liquid through a thickness of the sheet, and another area configured to prevent passage of debris through the thickness of the sheet;

a second set of indentations formed in the second region, the second set of indentations having an area configured to allow passage of liquid through the thickness of the sheet, and another area configured to prevent passage of debris through the thickness of the sheet; and a plurality of fasteners for securing each of the raised edge and the angled edge to the gutter;

wherein the first angle and the second angle are each acute angles measured from a horizontal plane.

2. The system of claim 1, wherein the first region extends from the angled edge to the dam, and the second region extends from the raised edge to the dam.

3. The system of claim 2, wherein the dam is a sloped protrusion that joins the first region with the second region.

4. The system of claim 1, wherein the first set of indentations comprises a first plurality of strips which are attached to the surface of the first region, and the second set of indentations comprises a second plurality of strips which are attached to the surface of the second region.

5. The system of claim 4, wherein no material is removed from the sheet when forming the first set of indentations and the second set of indentations.

6. The system of claim 1, further comprising a plurality of apertures in each of the raised edge and the angled edge, and wherein the plurality of fasteners are bolts.

7. The system of claim 1, wherein each of the first set of indentations and the second set of indentations comprise two or more rows, wherein each of the two or more rows include a plurality of discrete openings in the sheet.

8. The system of claim 7, wherein each row of the two or more rows is staggered from another row of the two or more rows.

9. The system of claim 1, wherein the sheet is made of metal.

10. The system of claim 1, wherein each of the first region and the second region are angled towards the dam.

11. The system of claim 1, wherein the raised edge extends from the second region at an eighty-degree angle.

12. A guard system for use with a gutter, comprising:

a sheet having a raised edge at an end and an angled edge at an opposing end, the angled edge having a first surface and a second surface coupled to the first surface;

a first region adjacent the angled edge, the first region extending down from the angled edge at a first angle;

a second region adjacent the raised edge, the second region extending down from the raised edge at a second angle;

a dam located between the first region and the second region, the dam being a protrusion that extends above both a majority of the first region and a majority of the second region;

a first set of indentations formed in the first region; and a second set of indentations formed in the second region;

wherein the first set of indentations and the second set of indentations are configured to allow liquid to pass through a thickness of the sheet while precluding passage of debris;

wherein:

the first angle and the second angle are each acute angles measured from a horizontal plane; and a width of the dam is about a width of the first surface.

13. The system of claim 12, wherein the guard system is removably attachable to the gutter.

14. The system of claim 12, wherein the guard system is made integral with the gutter.

15. The system of claim 12, further comprising a third region having a third set of indentations, and a second dam.

16. The system of claim 15, wherein the third region is arranged between the first region and the second region, and the second dam is arranged between the third region and one of the first region and the second region.

17. The system of claim 12, wherein the raised edge extends at a ninety-degree angle from the sheet.

18. A system for preventing debris from entering a gutter, comprising:

a sheet having a raised edge at an end and an angled edge at an opposing end, the angled edge having a first surface and a second surface coupled to the first surface;

a first region located between the raised edge and the angled edge, the first region extending down from the raised edge at a first angle and the first region extending down from the angled edge at a second angle;

a dam, the dam extending above a majority of the first region; and a first set of indentations formed in the first region, the first set of indentations comprising a plurality of discrete openings in the sheet;

wherein;

the first set of indentions allow only liquid to pass through a thickness of the sheet; and the first angle and the second angle are each acute angles measured from a horizontal plane.

19. The system of claim 18, further comprising a protective coating over a top surface of the sheet.

20. The system of claim 18, wherein the sheet and the gutter are both constructed of a first material.

* * * * *